US006089449A

United States Patent [19]

Butterworth

[11] Patent Number: 6,089,449

[45] Date of Patent: Jul. 18, 2000

[54] SELF-DEFENSE WHIP

[76] Inventor: Robert J. Butterworth, Salley Holler Rd., Harrisburg, Ill. 62946

[21] Appl. No.: 09/099,849

[22] Filed: Jun. 19, 1998

[51] Int. Cl.[7] ..... B68B 11/00; F41B 15/02

[52] U.S. Cl. ..... 231/4; 463/47.7; 231/2.1

[58] Field of Search ..... 231/2.1, 4, 5, 6; 463/47.6, 47.7

[56] References Cited

U.S. PATENT DOCUMENTS

| | | | |
|---|---|---|---|
| 109,297 | 11/1870 | Bushnell | 231/6 X |
| 815,458 | 3/1906 | Morris . | |
| 918,557 | 4/1909 | Keeport et al. . | |
| 1,013,240 | 1/1912 | Towery . | |
| 4,037,839 | 7/1977 | Nelson . | |
| 4,154,391 | 5/1979 | Girty | 231/3 |
| 4,456,255 | 6/1984 | Braunhut . | |
| 4,533,140 | 8/1985 | Champion . | |
| 4,687,131 | 8/1987 | von Braunhut | 231/2 R |
| 4,863,095 | 9/1989 | Crane | 231/2.1 |
| 5,031,827 | 7/1991 | von Braunhut | 231/3 |
| 5,149,092 | 9/1992 | Parsons . | |
| 5,320,348 | 6/1994 | Starret . | |
| 5,348,297 | 9/1994 | Parsons | 463/47.7 |
| 5,568,922 | 10/1996 | Siddle | 463/47.7 |
| 5,595,836 | 1/1997 | Parsons | 473/47.7 |
| 5,617,980 | 4/1997 | Parsons et al. | 224/251 |
| 5,690,552 | 11/1997 | Siddle | 463/47.7 |

*Primary Examiner*—Robert P. Swiatek
*Attorney, Agent, or Firm*—Grace J. Fishel

[57] ABSTRACT

A self-defense whip having an elongated hollow tube within which is telescopically received a flexible lash, preferably formed of flexible control cable. The tube has a constriction proximate one end and the lash has an anchor at one end which is axially movable in the tube but which will not pass through the constriction. The lash has a weighted tip at its other end which pulls the lash into extended whipping position and accelerates the tip into an arc leading the lash. When the lash is formed of flexible control cable, the whip makes an intimidating, whistling noise as it cuts through the air.

8 Claims, 2 Drawing Sheets

SELF-DEFENSE WHIP

BACKGROUND OF THE INVENTION

1. Field of the Invention

The present invention relates to a self-defense whip that can be conveniently carried by a user and readily placed into a whipping position for emergency use as a deterrent against attack.

2. Brief Description of the Prior Art

Nearly every jogger has a story about running innocently along and being suddenly confronted with a dog that is all teeth. Dogs are very territorial and, while most are mild-mannered, others seem to have a blood lust about guarding their turf.

The best way to avoid dog trouble is to respect the borders of the dog's territory by crossing the street. In doing this, however, it is essential to look and act confident. If the dog charges, a person should stand his or her ground and shout "No" as loudly and with as much authority as he or she can muster. If the dog is not intimidated and still set on attack, something defensive, as a very last resort, is in order.

Most joggers, however, have no real means for defending themselves against a dog attack and the protection that has been available has serious shortcomings. For example, some joggers carry sticks but sticks are heavy, cumbersome and may be tripped over. Others carry aerosol repellents, but if the dog is upwind, the spray may get on the jogger or if there is a cross wind, insufficient spray may get on the dog, only further to aggravate the animal, encouraging further confrontation.

There are other hazards besides dogs; most joggers have no defense against muggers either. Some joggers carry knives or guns but these weapons can be turned against them by the attacker. Other runners carry jogging weights that can double as brass knuckles but these devices are useful only on close contact. Sticks and aerosol repellents can be used against a human assailant too, but these weapons have the shortcomings mentioned above with respect to defending against a dog. There are mechanically complicated spring whips and telescoping batons, with push-button releases, etc., but the opening of these devices in an emergency may be too slow or foiled entirely by jamming of the release or of the adjacent lengths of springs or baton sections.

Joggers are not the only people in jeopardy of attack. It is not always possible to avoid deserted or poorly lit areas and some people are even fearful in their own homes, keeping weapons by their bedsides. People who work at night, students, nurses, etc. and who must walk across a campus or a parking lot may suddenly find that they have become an attractive target. Most people do not want to carry a lethal weapon like a gun, but, on the other hand, they do not want to be completely defenseless either.

BRIEF SUMMARY OF THE INVENTION

In view of the above, it is an object of the present invention to provide a deterrent against attack that empowers a user with confidence, discouraging confrontation. It is another object to provide a deterrent that is easy to carry and readily placed into defensive position for emergency use. Other objects and features of the invention will be in part apparent and in part pointed out hereinafter.

In accordance with the invention, a self-defense whip has a stiff elongated hollow tube within which is telescopically received a flexible lash. The tube has first and second ends and a longitudinal axis. The lash has first and second ends with an anchor at its first end and a weighted tip at its second end. The tube has a constriction proximate the second end through which the lash is axially movable but not the anchor. In use, the tip facilitates the projection of the lash into its extended whipping position when a user grips the tube near its first end and sharply rotates the longitudinal axis of the tube thereby accelerating the tip into an arc leading the lash.

When the tube and the lash are made of metal, preferably stainless steel, and the lash is a flexible multi-stranded wire cable, the lash makes a whistling, intimidating noise as it cuts through the air. The anchor and the weighted tip fit loosely in the tube such that the lash is brought into whipping position easily and quickly. Means may be provided for keeping the weighted tip seated in or on the tube when not needed for defense but such means are not preferred as they may interfere with the deployment of the device in an emergency.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which one of various possible embodiments of the invention is illustrated, corresponding reference characters refer to corresponding parts throughout the several views of the drawings in which.

DETAILED DESCRIPTION OF THE INVENTION

Figure 1:
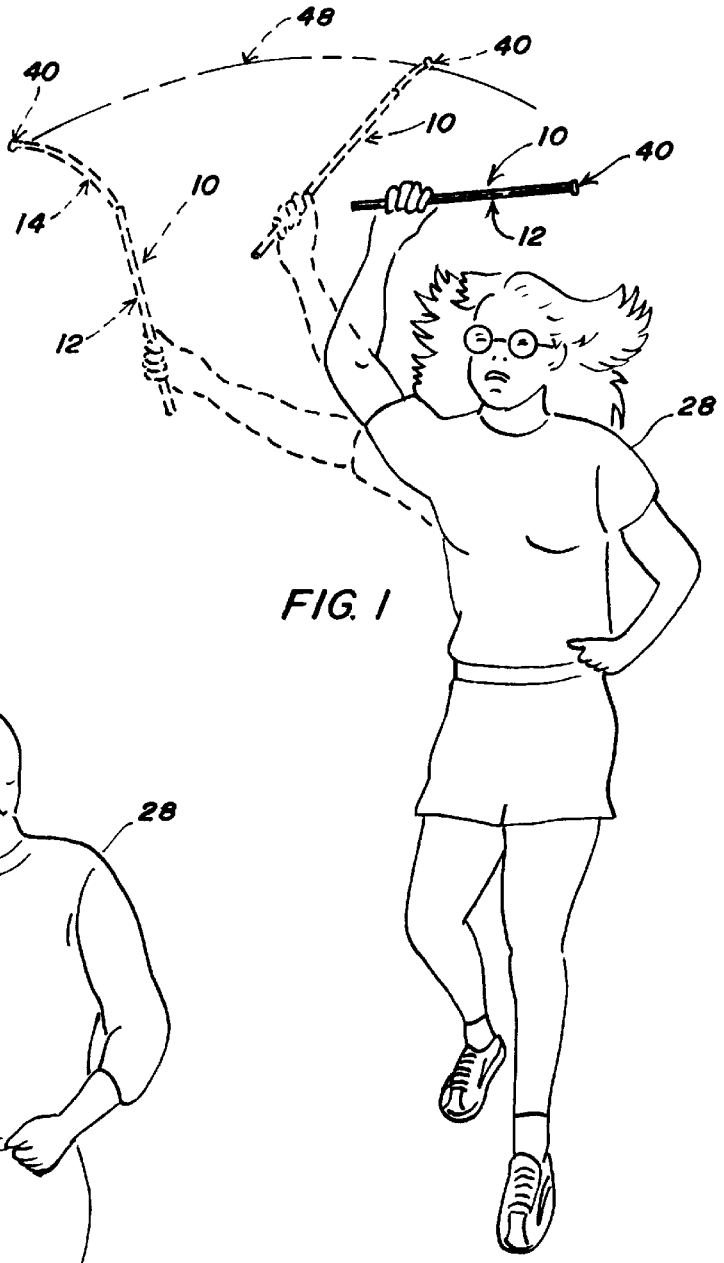
FIG. 1 is a perspective view of a jogger using a self-defense whip in accordance with the present invention against an attacker approaching her from the front.

Referring to the drawings more particularly by reference character, reference numeral 10 identifies a self-defense whip in accordance with the present invention. Whip 10 has a stiff elongated hollow tube 12 within which is telescopically received a flexible lash 14.

Figure 2:
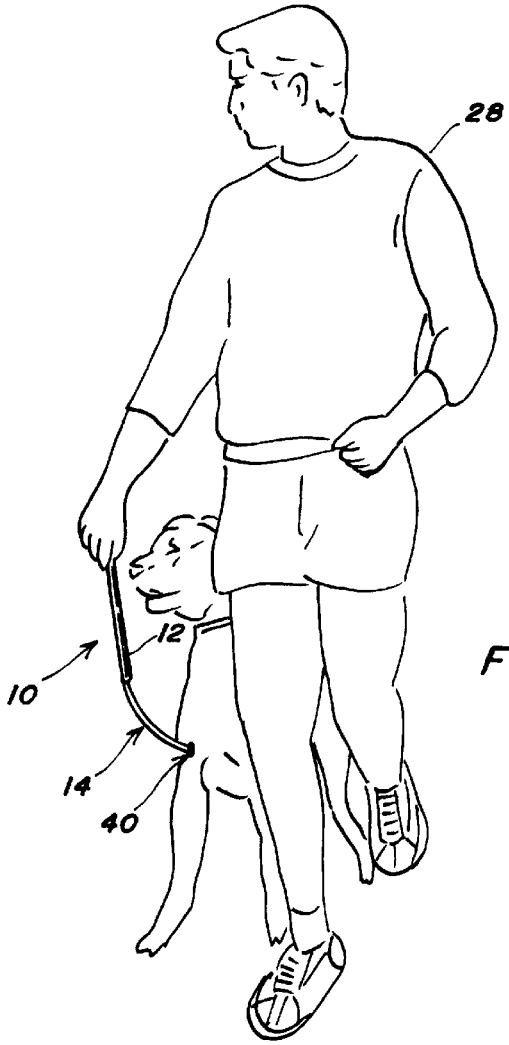
FIG. 2 is a perspective view of a jogger using the self-defense whip against an attacker approaching him from the rear.
Figures 3, 4, 5:
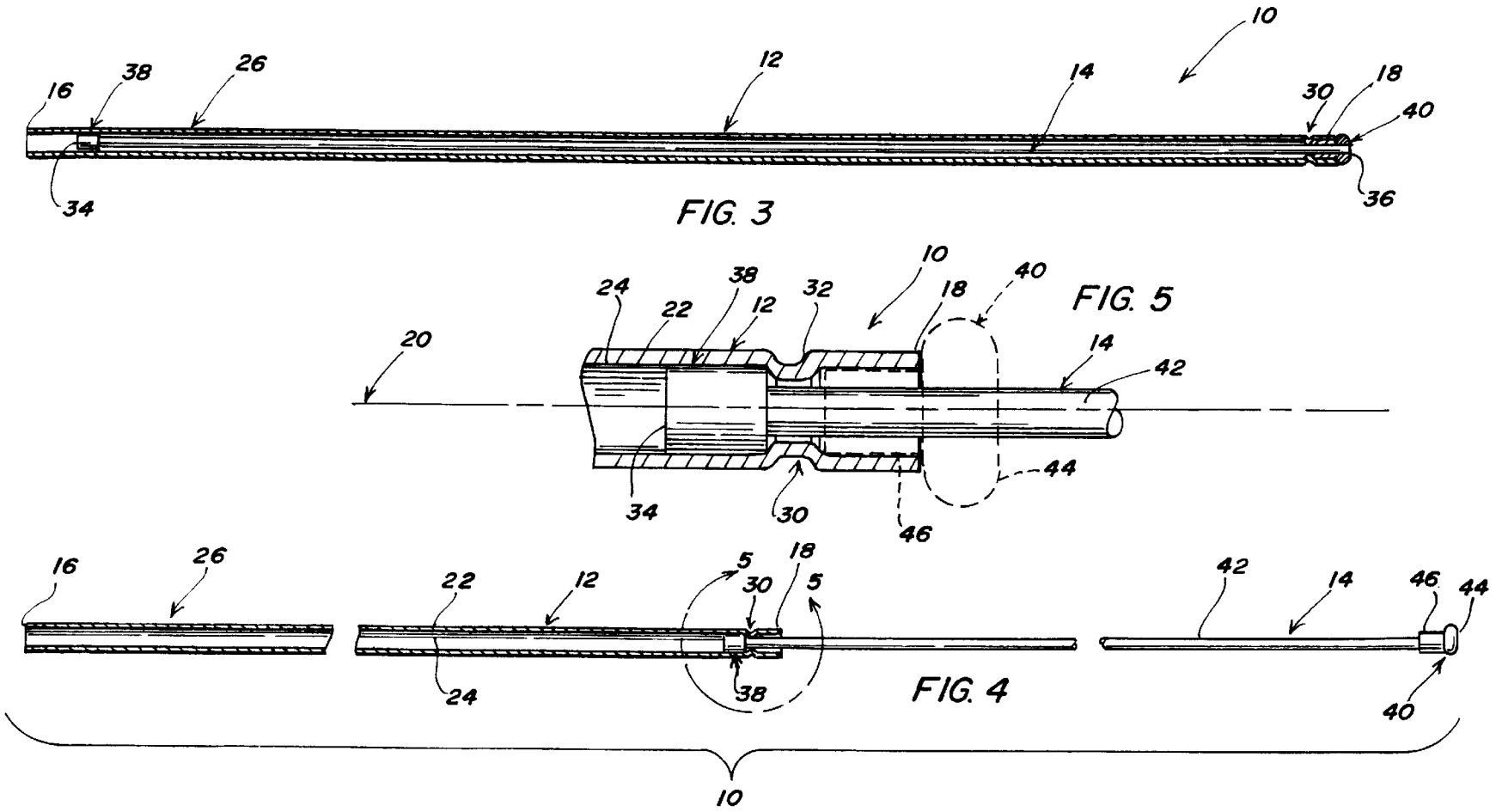
FIG. 3 is a side view partly in cross-section of the self-defense whip wherein a flexible lash is telescopically received in a stiff hollow tube.
FIG. 4 is a side view partly in cross-section of the self-defense whip with the lash in its extended whipping position; and, FIG. 5 is a detail, on an enlarged scale, taken along line 5—5 in FIG. 4.

Tube 12 is preferably cylindrical with first and second open ends 16, 18, respectively, and a longitudinal axis 20. Tube 12 has an outer peripheral wall 22 and an inner peripheral wall 24. Outer peripheral wall 22 adjacent first end 16 serves as a handle 26 which may be gripped by a user 28 as shown in FIGS. 1 and 2. Handle 28 may be provided with a knurled surface, typically a diamond checkered pattern or the like (not shown) to improve the quality of the grip. Tube 12 has a constriction 30 proximate its second end 18 as shown in FIGS. 3–5. In the form illustrated, constriction 30 is an annular groove which on inner peripheral wall 24 forms an inwardly projecting bead 32, as best seen in FIG. 5, for use as described hereinafter.

Lash 14 has first and second ends 34, 36, respectively, with an anchor 38 at its first end and a weighted tip 40 at its second end. Anchor 38 comprises a ferrule or metal band that is adapted to slide freely and smoothly along inner peripheral wall 24. Lash 14 has an outer peripheral wall 42 and is loosely received in tube 12 and axially movable through constriction 30. Anchor 38 does not pass through constriction 30 which serves as a positive stop for attaching lash 14 to tube 12. Weighted tip 40 includes a cap 44 which serves as a closure for second end 18 of tube 12. Cap 44 is preferably mounted on a hollow stem 46 which is adapted to slide freely and smoothly along inner peripheral wall 24 until stopped by cap 44 and is preferably receivable in tube 12 above constriction 30 as shown in FIG. 5.

Tube 12 may be, for example, formed of 5/16 inch stainless steel tube, 15⅝ inch long, having a wall thickness of 0.035 inch and an inside diameter of 5/32 inch. Lash 14 may be formed of ⅛ inch stainless steel cable, 15¼ inch long with anchor (band) 38 and stem 46 swedged on under 2,000 lbs. pressure. The cable is preferably extra flexible aircraft control cable made of seven strands of 19 wires each (Wicks Aircraft Supply part No. ⅛×1×19-SS). Band 38 is a sleeve made from one shank of a ball and double shank control cable assessory (part No. MS20663-C4). Integral cap 44 and stem 46 are made from the remainder. It will be understood that the above particulars are provided to satisfy the best mode disclosure requirement and that the invention is not limited thereto.

If tube 12 is made of a magnetic material or if second end 18 is outfitted with a magnetic insert, cap 44 or stem 46 may include a magnet such that weighted tip 40 is not dislodged from second end 18 under its own weight. As will be readily apparent, the same result could be obtained by providing a friction surface on stem 46 or on inner peripheral wall 24 of tube 12 near second end 18. It is preferred, however, that these steps not be taken as a magnetic, friction surface, etc. might interfere with extending lash 14 into whipping position.

In the construction of whip 10, tube 12 is formed from a length of tubing and constriction 30 formed in inner peripheral wall 24. Lash 14 is formed from a length of cable such that it is telescopically received in tube 12 and anchor 38 is crimped on first end 34. Second end 36 of lash 14 is passed through first end 16 of tube 12, through constriction 30 and out of second end 18, whereupon weighted tip 40 is crimped on second end 36. A decorative end button (not shown) can be inserted in first end 18, if desired. Once assembled, whip 10 cannot be taken apart without cutting weighted tip 40 off lash 14.

Self-defense whip 10 is lightweight and can be easily carried in a user's hand with very little effort and no loss of mobility. It can be stored in his or her briefcase, on a nightstand, in the map pocket of a car door, etc., readily available for use if needed. When user 28 grips tube 12 by handle 26 and sharply rotates longitudinal axis 20 of the tube, weighted tip 40 facilitates the projection of the lash into its extended whipping position and is accelerated into an arc 48 leading lash 14. This motion can be done in a downward and backward direction as shown in FIG. 2 to defend against a dog nipping at the user's heels or in a downward and forward direction as shown in FIG. 1 if the attacker is in front of the user. Because tip 40 is weighted, it is accelerated faster than lash 14 and is capable of delivering a disabling blow to an assailant, cutting through the air with a whistling noise.

The purpose of self-defense whip 10, however, is not to injure, but to empower the user with confidence such that confrontation is avoided. This works particularly well with dogs which are much more likely to attack if a person runs or otherwise shows fear and with a human attacker, the noise of the lash cutting through the air may be enough to deter an attack.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A self-defense whip comprising a stiff elongated hollow tube within which is telescopically received a flexible lash, in the form of a cable said tube having first and second ends and a longitudinal axis, said lash having first and second ends with an anchor at its first end and a weighted tip at its second end, said tube having a constriction proximate the second end through which the lash is axially movable but not the anchor, said tip facilitating the projection of the lash into its extended whipping position when a user grips the tube near its first end and sharply rotates the longitudinal axis of the tube thereby accelerating the tip into an arc leading the lash.

2. The self-defense whip of claim 1 wherein the tube has an outer peripheral wall and an inner peripheral wall and the constriction is an annular groove formed in the outer peripheral wall that forms an inwardly projecting bead on the inner peripheral wall.

3. The self-defense whip of claim 2 wherein the tube is formed of metal and the lash is a flexible control cable formed of multi-strands, each strand being formed of a plurality of wires.

4. A self-defense whip comprising a stiff elongated hollow tube within which is telescopically received a flexible lash, said tube having first and second ends and a longitudinal axis, said lash having first and second ends with a band crimped on its first end and a weighted tip crimped on its second end, said tube having a constriction proximate the second end through which the lash is axially movable but not the anchor, said tube being formed of metal and said lash being a flexible control cable, said tip facilitating the projection of the lash into its extended whipping position when a user grips the tube near its first end and sharply rotates the longitudinal axis of the tube thereby accelerating the tip into an arc leading the lash.

5. The self-defense whip of claim 4 wherein the tube has an outer peripheral wall and an inner peripheral wall and the constriction is an annular groove formed in the outer peripheral wall that forms an inwardly projecting bead on the inner peripheral wall.

6. The self-defense whip of claim 5 wherein the anchor is a sleeve swedged on the first end of the lash and the weighted tip is a single shank control accessory swedged on the second end of the lash.

7. The self-defense whip of claim 6 wherein the lash has an outer peripheral wall with an outside diameter of ⅛ inch and the inner peripheral wall of the tube has a diameter of 5/32 inch.

8. The self-defense whip of claim 7 wherein the tube and the lash are formed of stainless steel.

* * * * *